US005644831A

United States Patent [19]

Federico

[11] Patent Number: 5,644,831

[45] Date of Patent: Jul. 8, 1997

[54] METHOD FOR CONSTRUCTION OF A UNIVERSAL MODULAR APPARATUS FOR SELECTIVELY FORMING CURVED CONCAVE AND CONVEX SECTIONS OF A REFRIGERATED DISPLAY CASE

[75] Inventor: Joseph A. Federico, Titusville, N.J.

[73] Assignee: Delaware Capitol Formation Inc., Wilmington, Del.

[21] Appl. No.: 552,324

[22] Filed: Nov. 2, 1995

Related U.S. Application Data

[62] Division of Ser. No. 340,933, Nov. 17, 1994, Pat. No. 5,501,516.

[51] Int. Cl.[6] ..... B21D 39/00

[52] U.S. Cl. ..... 29/455.1; 29/460

[58] Field of Search ..... 29/890.035, 897.32, 29/412, 413, 414, 415, 455.1, 460, 530

[56] References Cited

U.S. PATENT DOCUMENTS

| | | |
|---|---|---|
| 3,751,653 | 8/1973 | Henry . |
| 4,267,706 | 5/1981 | Abraham . |
| 4,314,457 | 2/1982 | Ibrahim . |
| 4,314,458 | 2/1982 | Hade et al. . |
| 4,337,626 | 7/1982 | Ibrahim . |
| 4,400,046 | 8/1983 | Karashima . |
| 4,777,806 | 10/1988 | Perez . |

FOREIGN PATENT DOCUMENTS

| | | |
|---|---|---|
| 242713A | 10/1987 | European Pat. Off. . |
| 3027520 | 3/1981 | Germany . |
| 2126696 | 3/1984 | United Kingdom . |
| 2198030 | 6/1988 | United Kingdom . |

*Primary Examiner*—David P. Bryant
*Attorney, Agent, or Firm*—Sperry, Zoda & Kane

[57] ABSTRACT

A method and apparatus for forming refrigerated display cases with both convex and concave curved case sections utilizing a single outer modular member for forming the outer canopy and tank portions of both convex and concave curved sections as well as an inner modular member useful for forming canopy and tank sections of both concave and convex refrigerated display case sections.

11 Claims, 5 Drawing Sheets

METHOD FOR CONSTRUCTION OF A UNIVERSAL MODULAR APPARATUS FOR SELECTIVELY FORMING CURVED CONCAVE AND CONVEX SECTIONS OF A REFRIGERATED DISPLAY CASE

This application is a division of U.S. Ser. No. 08/340,933, filed Nov. 17, 1994, now U.S. Pat. No. 5,501,516.

BACKGROUND OF THE INVENTION

1. Field of the Invention

The present invention pertains to refrigerated display cases and in particular refrigerated display cases including open frontal areas with the refrigerated air curtains extending thereover. Refrigerated display cases require an extensive number of structural elements dedicated to insulating the interior of the housing from the exterior due to the great temperature differential between the interior of such a refrigerated display case and the ambient environment.

The present invention provides a novel means for forming of this insulated exterior configuration in constructions for forming non-linear refrigerated display case sections. The sections can be convex or concave and are useful within a retail outlet in locations where the bank of refrigerated display cases must turn either in a convex or concave manner for inside or outside turn as required by the demands of the store owner or other restrictions such as structural restrictions in the supermarket building itself. The present invention provides a novel and an expedited means for forming the insulated housings for such arcuate sections.

2. Description of the Prior Art

Many prior art designs have been suggested for forming arcuate refrigerated display cases such as U.S. Pat. No. 4,267,706 issued May 19, 1981 to F. Ibraham and assigned to Tyler Refrigeration Corporation on a "Shop Around Refrigerated Merchandiser"; and U.S. Pat. No. 4,314,457 issued Feb. 9, 1982 to F. Ibrahim and assigned to Tyler Refrigeration Corporation on a "Island Refrigerated Display Case With Air Defrost"; and U.S. Pat. No. 4,314,458 issued Feb. 9, 1982 to C. Hade et al and assigned to Dalcon Marketing Inc. on a "Refrigerated Display Case"; and U.S. Pat. No. 4,337,626 issued Jul. 6, 1982 to F. Ibrahim and assigned to Tyler Refrigeration Corporation on a "Well Type Refrigerated Case With Defrost Air Intake And Colliding Band Air Defrost"; and U.S. Pat. No. 4,777,806 issued Oct. 18, 1988 to A. Perex and assigned to Stanely Knight Corporation on a "Refrigerated Display Island".

SUMMARY OF THE INVENTION

The present invention provides a universal modular apparatus for selectively forming curved sections of a refrigerated display case. These cases preferably include a canopy in the upper area thereof and a tank section in the lower area thereof. Refrigerated display cases require some type of thermally insulated housing and the present invention provides a means for forming of this housing in both the concave as well as a convex shaped non-linear refrigerated display case.

In construction, the present invention is designed to provide a single outer modular member which itself is capable of selectively forming either an outer concave tank liner, an outer concave canopy liner, an outer convex tank liner or an outer convex canopy liner for a thermally insulated housing for a curved refrigerated display case. As such, the outer modular member will preferably be capable of forming any outer liner piece in the canopy or tank area of either a concave or convex refrigerated display case configuration.

The outer modular member preferably will be configured to include an outer horizontal panel which is generally planar and is arc shaped and includes four ends. The first end is a first outer longitudinal end preferably straight and a second outer longitudinal end preferably also straight which is positioned oppositely along the outer horizontal panel from the first outer longitudinal end. Preferably the second outer longitudinal end will be oriented approximately perpendicularly with respect to the first outer longitudinal end but will not intersect that end in order to form the arc shaped configuration. An outer narrow arcuate end will extend between the first outer longitudinal end and the second longitudinal end and an outer wide arcuate end will extend between the first outer longitudinal end and the second outer longitudinal end. This outer wide arcuate end will preferably be longer in is horizontal length than the outer narrow arcuate end. It should be appreciated that the above modular member is normally formed with the multiple sections thereof integrally formed with respect to one another to comprise a single modular piece despite these panels being separately described and defined herein.

The outer modular member will also include an outer narrow vertical panel extending upwardly from the outer narrow arcuate end and generally perpendicularly with respect to the outer horizontal panel. The outer modular member will also include an outer narrow corner member extending between the outer narrow arcuate end and the outer narrow vertical panel. This outer narrow corner member will be arcuate and extend through an angle of preferably 90 degrees with a radius of curvature of approximately eight inches. An outer wide vertical panel will also extend upwardly from the outer wide arcuate end generally perpendicularly with respect to the outer horizontal panel.

An outer wide corner member will extend between the outer wide arcuate end and the outer wide vertical panel. This outer wide corner member will preferably be curved and extend through an angle of approximately 90 degrees with a radius of curvature of approximately eight inches.

Although the wide and narrow panels and the respective corner members are separately described and defined, it should be appreciated that the entire modular member is normally formed with multiple sections integrally joined with respect to one another to comprise a single modular piece.

The outer modular member so configured will include a plurality of lining means thereon designed to provide patterns for cutting therealong of the outer modular member in order to form the different shapes required for both tank and canopy sections of both concave and convex refrigerated display case sections.

The outer modular member will include a first outer lining extending approximately horizontal therealong at an intermediate location on the outer narrow vertical panel for indicating the position for cutting of the outer modular member to facilitate use thereof as the outer tank liner of a concave tank section of a refrigerated display case.

The outer modular member will also preferably include a second outer lining which includes two portions which are defined as the major second outer lining and the minor second outer lining. The major second outer lining preferably extends through an arc passing across the outer horizontal panel from the first outer longitudinal end to the second outer longitudinal end thereof for indicating the position for cutting of the outer modular member for facilitating use thereof as the outer liner of a convex canopy section of a refrigerated display case. On the other hand the minor second outer lining preferably extends approximately horizontally at an intermediate location on the outer wide vertical panel for indicating the position for cutting of the outer modular member for facilitating use thereof as the outer liner of a concave canopy section of a refrigerated display case. As such, both the major and minor second outer lining are required for usage of the outer modular member as the outer liner of a concave canopy section.

The outer modular member preferably also includes a third outer lining means extending approximately horizontally at an intermediate location on the outer wide vertical panel for indicating the position for cutting of the modular member for facilitating use thereof as the outer liner of a convex tank section of a refrigerated display case. This third outer lining is preferably positioned on the outer wide vertical panel at a location thereof which is closer to the outer wide corner member than the minor second outer lining.

A fourth outer lining is preferably included on the outer modular member which includes a major fourth outer lining as well as a minor fourth outer lining. The major fourth outer lining is positioned extending through an arc passing across the outer horizontal panel from the first outer longitudinal end to the second outer longitudinal end thereof for indicating the position for cutting of the outer modular member therealong for facilitating use thereof as the outer liner of a concave canopy section of a refrigerated display case. This major fourth outer lining is preferably positioned on the outer horizontal panel at a position farther from the outer narrow corner member than the major second outer lining. On the other hand the minor fourth outer lining extends approximately horizontally at an intermediate location on the outer narrow vertical panel for indicating the position for cutting of the outer modular member therealong for facilitating use thereof as the outer liner of a convex canopy section of a refrigerated display case. This minor fourth outer lining is preferably positioned on the outer narrow vertical panel at a position farther from the outer narrow corner member than the first outer lining.

The outer modular member may further include a plurality of outer radial lines extending radially thereacross spatially disposed with respect to one another at an angle of approximately 15 degrees therebetween to facilitate formation of curved sections of refrigerated display cases of less than 90 degrees. While these radial lines show the exact locations for cutting of the outer modular members at 15, 30, 45, 60 and 75 degrees, they also allow for quite accurate interpolation therebetween for formation of a refrigerated display case section having virtually any angle measurement greater than 0 degrees up to and including 90 degrees.

The apparatus of the present invention further includes a plurality of inner modular members each being capable of selectively forming an inner concave tank liner and an inner concave canopy liner, an inner convex tank liner and an inner convex canopy liner for a thermally insulated housing for a curved refrigerated display case. The inner modular members basically include the same panels and lining means as defined in the outer panels. However, the inner panels include an inner narrow corner member and an inner wide corner member that have a radius of curvature less than that of the outer narrow corner member and the outer wide corner member. Preferably, with the outer wide corner member and the outer narrow corner member having a radius of curvature of approximately eight inches, then the inner narrow corner member and the inner wide corner member will include a radius of curvature of approximately six inches. That difference is useful for the purposes of providing sufficient clearance between these two panels when positioned adjacent to one another in a refrigerated display case to receive insulated material therebetween. The inner modular member is also preferably formed as a singularly formed member with multiple sections defined thereon such as the wide sections, narrow sections, arc sections, and vertical and corner panels.

In the method of use of the apparatus of the present invention, the outer modular member and the inner modular member are designed to form the outer and inner panels, respectively, for a canopy or tank section for a concave or convex refrigerated display case section. They are designed to be mounted in spaced relation with respect to one another by one or more end separators in such a manner as to define an insulation receiving chamber therebetween which can receive insulation placed therein to facilitate thermal insulation of the arcuate refrigerated display cases from the surrounding environment.

One of the unique advantages of the curved sections of refrigerated display cases formed by the apparatus of the present invention is in the configuration of the ends. The ends of the curved case sections, either concave or convex, have the same profile or configuration as the ends of the straight cases thereby greatly facilitating securement and interconnection therebetween. In this manner a smooth flowing and handsome line of cases can be positioned within a retail supermarket which includes both curved and straight sections without noticeable transitions or gaps or interconnecting members therebetween.

It is an object of the present invention to provide a universal modular apparatus for selectively forming curved sections of refrigerated display cases wherein components parts and assembly costs are minimized.

It is an object of the present invention to provide a universal modular apparatus for selectively forming curved sections of refrigerated display cases wherein maintenance costs are significantly lowered.

It is an object of the present invention to provide a universal modular apparatus for selectively forming curved sections of refrigerated display cases wherein a single outer panel can be utilized to form outer panels of the insulated housing assembly for convex or concave canopy or tank portions of refrigerated display cases.

It is an object of the present invention to provide a universal modular apparatus for selectively forming curved sections of refrigerated display cases wherein a single inner panel can be configured to form the inner liner of canopy and tank portions of convex and concave refrigerated display cases used.

It is an object of the present invention to provide a universal modular apparatus for selectively forming curved sections of refrigerated display cases wherein an insulated housing can be formed for a refrigerated display case that is non-linear and is either convex or concave in both the canopy and tank portions from two modular units.

It is an object of the present invention to provide a universal modular apparatus for selectively forming curved sections of refrigerated display cases wherein insulated wall housings include textured surfaces such as hair cell texturing for enhancing the adherence of thermal insulation thereto positioned between the panels.

It is an object of the present invention to provide a universal modular apparatus for selectively forming curved sections of refrigerated display cases wherein radial lines at 15 degree angles are defined on modular units to facilitate the formation of convex and concave refrigerated panel sections measuring at any angle less than or equal to 90 degrees.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

The present invention provides a unique apparatus and method for forming a refrigerated display case 10 into a convex curved section 34 and/or a concave curved section 36. A concave 45 degree case section is best shown in FIG. 10 and a convex curved case section 34 extending through an angle of 45 degrees is best shown in FIG. 9.

Figure 9:
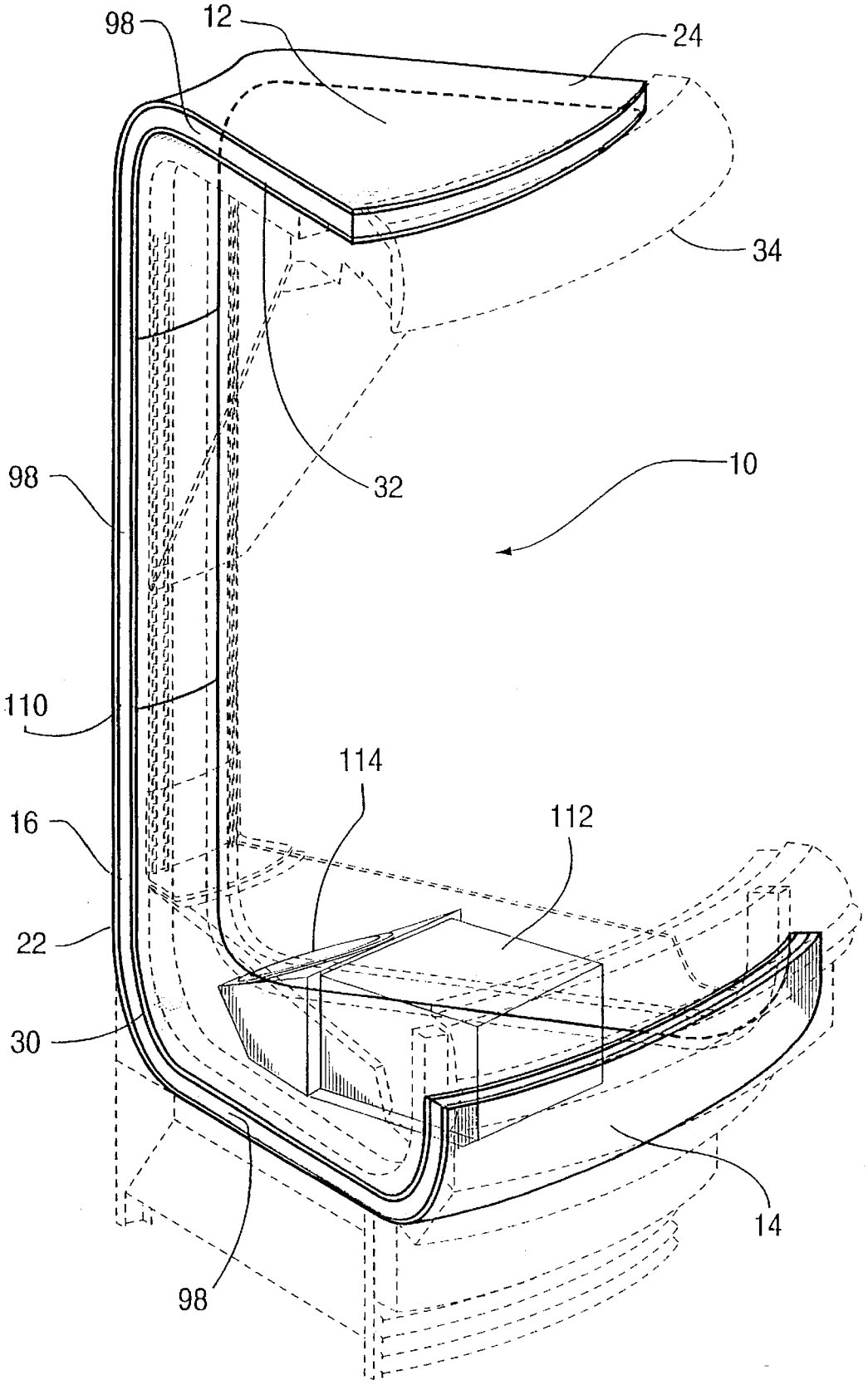
FIG. 9 is a perspective illustration of an embodiment of a convex refrigerated display case section extending through approximately 45 degrees.
Figure 10:
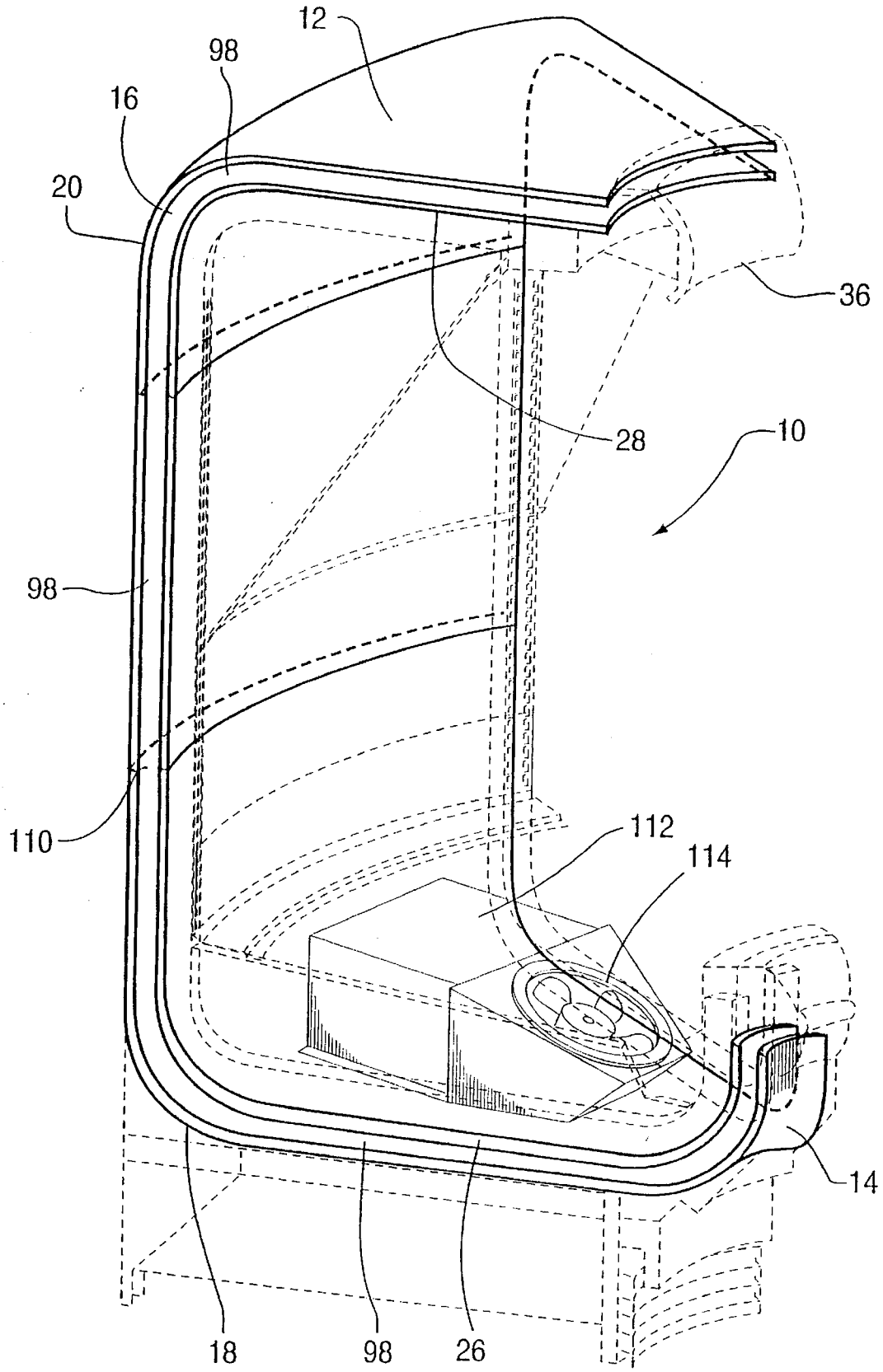
FIG. 10 is a concave illustration of an embodiment of a concave refrigerated display case extending through approximately 45 degrees.

In order to form a refrigerated display case with curved sections, it is preferable to initially define the sections as being either convex as shown in FIG. 9 or concave as shown in FIG. 10. The apparatus of the present invention provides a means for forming these cases to extend through convex or concave angles of 90 degrees or less and greater than 0 degrees. As such, the present invention provides a method and apparatus for forming a refrigerated display case 10 which extends through angles of 15, 30, 45, 60, 75 or 90 degrees or any other angle within this range by interpolation therebetween. In particular, concave or convex sections having angular measurements not equal to these specific angle measurements can be formed by carefully interpolating between adjacent radial lines. The configuration shown in FIGS. 9 and 10 show curved designs extending through a 45 degree angle as examples.

The method of forming the insulated housing of the refrigerated display case is by the inclusion of outer modular members 38 and inner modular members 58.

Outer modular member 38 is configured as a single integral member having multiple separately defined but mutually integral sections or panels such as outer horizontal panel 40 which defines four ends. These ends include a first outer longitudinal end 42 and a second outer longitudinal end 44 which is preferably oriented perpendicularly with respect to the first outer longitudinal end 42 and non-intersecting therewith prior to any cutting of the basic modular member 38. As such, as shown best in FIG. 1, this outer horizontal panel 40 will be generally arc shaped and include an outer narrow arcuate end 46 extending between the proximate or closer ends of the ends 42 and 44 and will include an outer wide arcuate end 48 which is longer than the outer narrow arcuate end 46 extending between the spatially distant ends of the first outer longitudinal end 42 and second outer longitudinal end 44.

Figure 1:
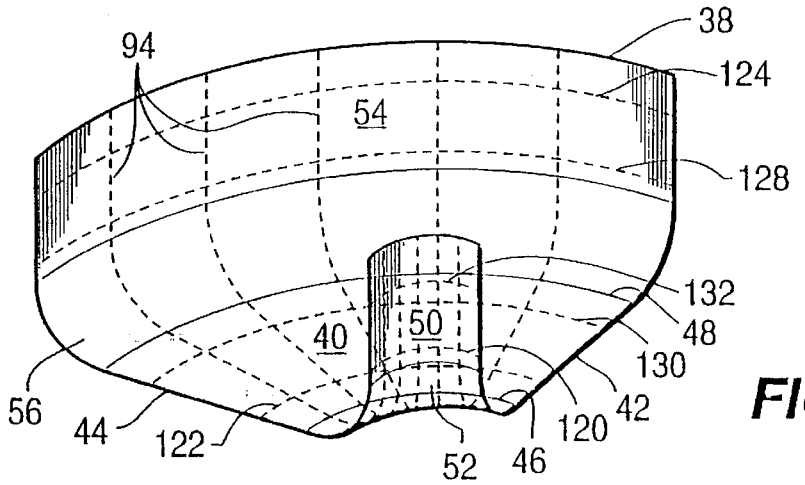
FIG. 1 is a perspective illustration of an embodiment of the outer modular member used with the present invention.

This outer modular member 38 as depicted in FIG. 1 will also include an outer narrow vertical panel 50 extending vertically upward therefrom with an outer narrow corner member 52 interconnecting the outer narrow vertical member 50 with respect to the outer narrow arcuate end 46 of outer horizontal panel 40. Preferably this outer narrow corner member 52 will be arcuate to extend through an angle of approximately 90 degrees with a radius of curvature preferably in the area of approximately eight inches. In a similar manner at the opposite or wide end of the first and second ends 42 and 44 an outer wide vertical panel will extend upwardly therefrom which will be interconnected to the outer horizontal panel 40 by way of an outer wide corner member 56 which will also preferably be arcuate and have a radius of curvature of approximately eight inches.

Figure 2:
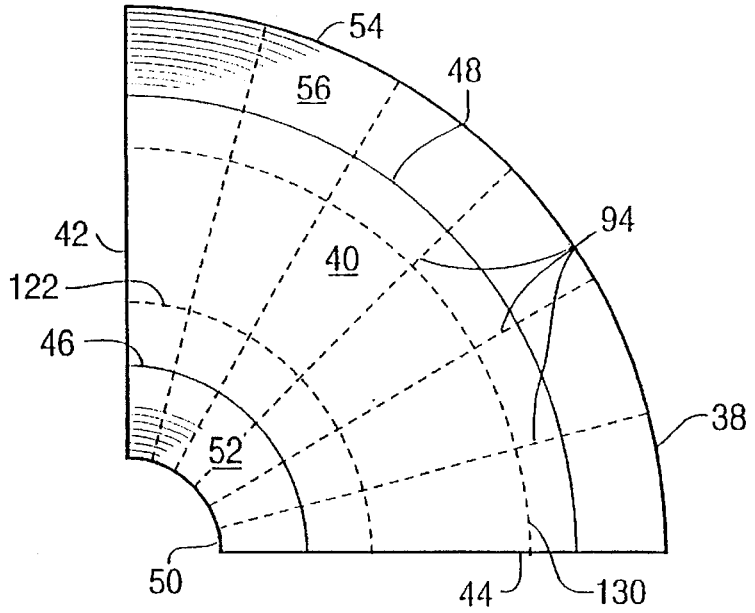
FIG. 2 is a bottom plan view of the configuration shown in FIG. 1.

This integrally formed outer modular member 38 will have the capability for forming the outer liner of the insulated housing in the tank area or the canopy area of a concave or convex refrigerated display case. This is made possible by a plurality of lining means located along the surface of the outer modular member 38 for providing ease in modifying of this panel in such a manner as to form these four differently designed pieces from the singular modular member. Also the outer modular member 38 will include a plurality of outer radial lines 94 extending therealong at angles of approximately 15 degrees with respect to one another as shown best in FIGS. 1 and 2 to facilitate formation of the insulated housing of the refrigerated display case to extend through any angles greater than zero if a smaller arc section than ninety degrees is required. Thus we see that this singular member is capable of forming any outer piece on any concave or convex tank or canopy area of a refrigerated display case.

Although these panels are separately described and defined, it should be appreciated that the outer modular member 38 is normally formed with the multiple sections thereof integrally joined with respect to one another to comprise a single modular piece. These multiple sections include the outer horizontal panel 40, the outer narrow vertical panel 50, the outer wide vertical panel 54, the outer narrow corner member 52 and the outer wide corner member 56. While these panels are all separately described and defined, they will preferably be formed together into a single integral piece defined as the outer modular member 38.

Figure 5:
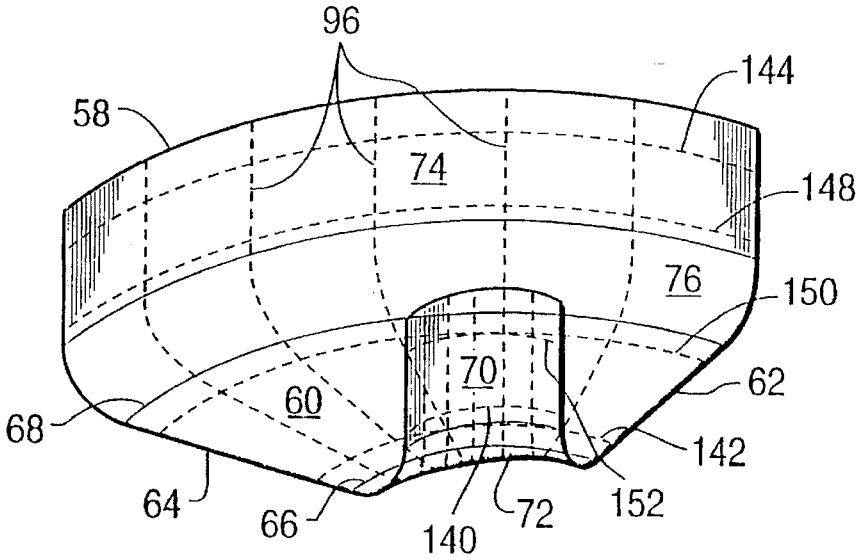
FIG. 5 is a perspective illustration of an embodiment of the inner modular member used with the present invention.
Figure 6:
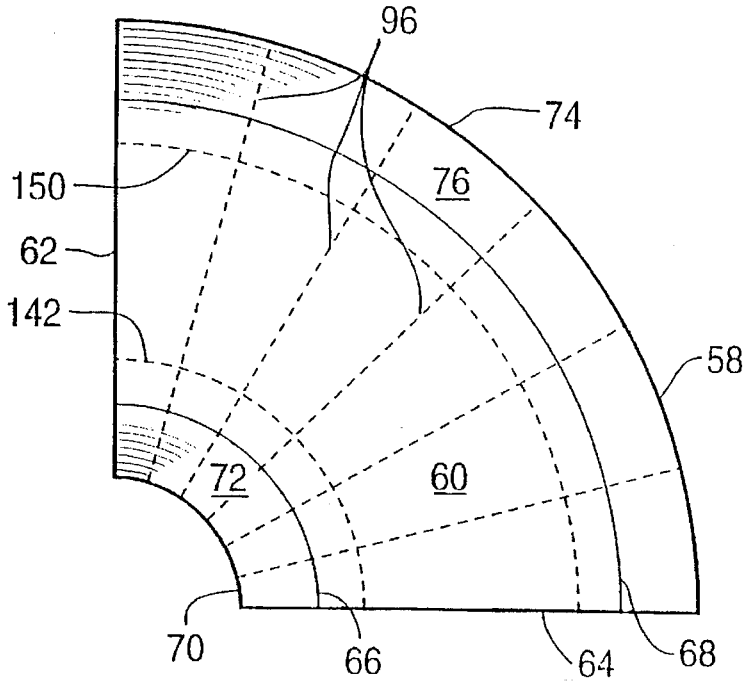
FIG. 6 is a bottom plan view of the configuration shown in FIG. 5.

In a similar manner a singularly formed one-piece inner horizontal panel 60 as shown best in FIG. 5 may be included which includes a first inner longitudinal end 62 and a second inner longitudinal end 64 thereon. Second inner longitudinal end 64 is preferably oriented perpendicularly with respect to the first inner longitudinal end 62 but not intersecting therewith. In this manner an arc shaped configuration is defined in the horizontal panel as seen best in FIG. 6. The close ends of first and second inner longitudinal ends 62 and 64 will be interconnected by an inner narrow arcuate end 66. In a similar manner the more distantly spaced ends of the first inner longitudinal end 62 and the second inner longitudinal end 64 will be interconnected by an inner wide arcuate end 68 which is of significantly greater length than the inner narrow arcuate end 66.

An inner narrow vertical panel 70 will extend upwardly from the inner modular member 58 and approximately perpendicularly with respect thereto. This inner narrow vertical panel 70 will be interconnected with respect to the inner horizontal panel 60 through an inner narrow corner member 72 which will be arcuate through an angle of approximately 90 degrees and will have a radius of curvature preferably of approximately six inches.

In a similar manner an inner wide vertical panel 74 will extend vertically with respect to the inner modular member 58 and will include an inner wide corner member 76 extending therebetween through an angle of approximately 90 degrees with a radius of curvature of approximately six inches.

Although these panels are separately described and defined, it should be appreciated that the inner modular member 58 is normally formed with the multiple sections thereof integrally joined with respect to one another to comprise a single modular piece. These multiple sections include the inner horizontal panel 60, the inner narrow vertical panel 70, the inner wide vertical panel 74, the inner narrow corner member 72 and the inner wide corner member 76. While these panels are all separately described and defined, they will preferably be formed together into a single integral piece defined as the inner modular member 58.

In this manner the inner modular member 58 will achieve a configuration very similar to the outer modular member 38 however with curved sections in the corner members 72 and 76 having a radius of curvature less than the radius of curvature of the corner members 52 and 56 of the outer modular member 38. In this manner when these members are positioned adjacent to one another in spaced relation separated by the end separators 98 in the case configuration shown in FIGS. 9 and 10, an insulation chamber 110 will be defined therebetween which is significantly facilitated by the generally uniform dimension resulting from the smaller radius of curvature of the corners of the inner modular member 58.

When forming a refrigerated display case the upper or canopy area 12 is a reverse of the configuration of the lower or tank area 14. It is preferable to form a thermal insulated housing 16 which extends along both the canopy area 12 and the lower tank area 14. This thermally insulated housing requires an inner and outer element in the canopy area 12 as well as within the tank area 14. For a concave configuration as shown in FIG. 10 the thermally insulated housing 16 will include an outer concave tank liner 18 as well as an inner concave tank liner 26 spaced from one another to define an insulation chamber 110 therebetween. This sandwiched configuration will provide the insulation construction in the tank configuration of a concave refrigerated display case. The canopy area also requires a thermally insulated housing 16 and in the concave configuration of FIG. 10 an outer concave canopy liner 20 will be included positioned adjacent to an inner concave canopy liner 28 to define therebetween an insulation chamber 110 for facilitating thermal insulation of the canopy area of a refrigerated display case 10.

In the convex configuration shown best in FIG. 9 the thermally insulated housing 16 will include an outer convex tank liner 22 spatially disposed from an inner convex tank liner 30 to define the insulation chamber 110 therebetween. In a similar manner the outer convex canopy liner 24 will be positioned adjacent to an inner convex canopy liner 32 to define the insulation chamber 110 therebetween for providing further insulation of the convex shaped curved refrigerated display case shown in FIG. 9.

In order to facilitate the positioning of insulation between the outer modular member 38 and the inner modular member 58 it is preferably to include a textured surface thereon such as a "hair cell" texture. Preferably this outer textured surface 90 on the outer modular member 38 is positioned adjacent to the surface which will contact the insulation within insulation chamber 110. In a similar manner preferably the inner textured surface 92 of the inner modular member 58 will be oriented such as to contact the insulation positioned within insulation chamber 110 thereagainst. With this configuration maintenance of thermal insulation from the ambient environment is achieved to achieve full and efficient operation of the refrigeration system which includes the conventional evaporator coil 112 and fan 114 therein.

To further facilitate use of the inner modular member 58 of the present invention with respect to curved refrigerated display cases of less than 90 degrees a plurality of inner radial lines 96 may extend outwardly along the inner modular member 58 at angular orientations with respect to one another of approximately 15 degrees to facilitate cutting thereof for forming of a curved display case section of less than 90 degrees.

The outer modular member 38 of the present invention preferably includes a plurality of lining means thereon to facilitate cutting thereof for forming of the various canopy or tank portions of convex or concave curved cases. This lining can comprise outer "witness lines" or can comprise outer impression lines which are actual depressions in the formed material of the modular member. In other words the lining can be an external marking or can be an actual embedded marking in the material. In a similar manner the inner modular member 58 can include inner witness lines thereon or inner impression lines thereon for any of the lining means to be described hereafter.

Preferably the outer modular member 38 includes a first outer lining means 120 which extends approximately horizontally at an intermediate location on the outer narrow vertical panel 50 for indicating the position for cutting of the outer modular member 38 for facilitating use thereof as the outer tank liner of a concave section of a refrigerated display case 10.

Additionally the outer modular member 38 preferably includes a second outer lining means which includes two actual line configurations referred as the major second outer lining 122 and the minor second outer lining 124. Major second outer lining 122 extends through an arc passing across the outer horizontal panel 40 from the first outer longitudinal end 42 to the second outer longitudinal end 44 thereof for indicating the position for cutting of the outer modular member 38 therealong for facilitating use thereof as the outer liner of a concave canopy section of a refrigerated display case. When used in this manner the outer modular member 38 as shown in FIG. 1 will be inverted after so cut for use as the outer canopy liner. In this use it will also be necessary to cut along the minor second outer lining 124 which extends approximately horizontally at an intermediate location on the outer wide vertical panel for indicating the position for cutting of the outer modular member therealong for facilitating use as the outer liner of a concave canopy section for a refrigerated display case. As such, cutting along the major second outer lining 122 and the minor second outer lining 124 will both be required for use of the outer modular member 38 as the outer liner of a concave canopy section.

Additionally outer modular member 38 will include a third outer lining means 128 extending approximately horizontally at an intermediate location on the outer wide vertical panel for indicating the position for cutting of the outer modular member 38 therealong to aid in use thereof as the outer liner of a convex tank section. This third outer lining means 128 is preferably positioned on the outer wide vertical panel 54 at a location thereon closer to the outer wide corner member 56 than to the minor second outer lining 124.

Outer modular member 38 also preferably includes a fourth outer lining means which includes two lining configurations. Initially it includes both a major fourth outer lining 130 as well as a minor fourth outer lining 132. Major fourth outer lining 130 extends through an arc passing across the outer horizontal panel 40 from the first outer longitudinal end 42 to the second outer longitudinal end 44 for indicating the position for cutting of the outer modular member 38 for use thereof as the outer liner of a convex canopy section. This major fourth outer lining 130 is preferably positioned on the outer horizontal panel 40 at a position farther from the outer narrow corner member within the major second outer lining 122. This usage will also require cutting along the minor fourth outer lining 132 which extends approximately horizontally at an intermediate location on the outer narrow vertical panel 50 for indicating the position for cutting therealong for use as the outer liner of a convex canopy section of a refrigerated display case. Most preferably this minor fourth outer lining 132 is positioned on the outer narrow vertical panel 50 at a position farther from the outer narrow corner member 52 than the first outer lining means 120.

In a similar manner the inner modular member 58 will include lining means thereon to facilitate modification thereof for use in the canopy and tank area of the inner liners of both convex and concave refrigerated display case sections. Inner modular member 58 will preferably include a first inner lining means 140 extending approximately horizontally at an intermediate location on the inner narrow vertical panel 70 for indicating the position for cutting of the inner modular member for facilitating use thereof as the inner liner of a concave tank section.

Also the inner modular member 58 will include a second inner lining means 141 which includes both a major inner second lining 142 and a minor second inner lining 144. The major inner second lining 142 extends through an arc passing across the inner horizontal panel 60 from the first inner longitudinal end 62 to the second inner longitudinal end 64 thereof for indicating the position for cutting for facilitating use thereof as the inner liner of a concave canopy section. This use will also require cutting along the minor second inner lining 144 which extends approximately horizontally at an intermediate location on the inner wide vertical panel 74 for indicating the position for cutting thereof to facilitate use as the inner liner of a concave canopy section of a refrigerated display case.

The inner modular member 58 will also preferably include a third inner lining 148 extending approximately horizontally at an intermediate location on the inner wide vertical panel 74 for indicating the position for cutting thereof for facilitating use as the inner liner of a convex tank section of refrigerated display case. This third inner lining 148 will preferably be positioned on the inner wide vertical panel 74 at a location thereon closer to the inner wide corner member 76 than the minor second inner lining 144 as shown best in FIGS. 5 and 7.

The inner modular member 58 will also preferably include a fourth inner lining means which includes a major fourth inner lining 150 as well as a minor fourth inner lining 152. Major fourth inner lining 150 extends through an arc passing across the inner horizontal panel 60 from the first inner longitudinal end 62 thereof to the second inner longitudinal end 64 thereof for indicating the position for cutting of the inner modular member 58 therealong for facilitating use thereon as the inner liner of a convex canopy section. This major fourth inner lining 150 preferably is positioned on the inner horizontal panel 60 at a position farther from the inner narrow corner member 72 than the major inner second lining 142. This use will also require a minor fourth inner lining 152 extending approximately horizontally at an intermediate location on the inner narrow vertical panel 70 for indicating the position for cutting of each inner modular member 58 therealong for facilitating use thereof as the inner liner of a convex canopy section. This minor fourth inner lining 152 is preferably positioned on the inner narrow vertical panel 70 at a position farther from the inner narrow corner member than the first inner lining means 140.

Thus we see that both the outer modular member 38 and inner modular member 58 include lining means thereon for eliminating unnecessary material from the basic modular part to facilitate that modular part for use as the outer or inner liner of a canopy or tank section of a convex or concave refrigerated display case section as necessary.

Figure 4:
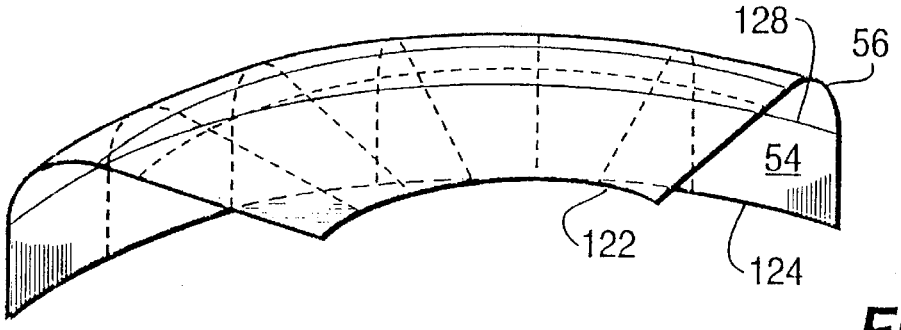
FIG. 4 is a perspective illustration of an embodiment of the configuration as shown in FIG. 1 shown cut for use in forming the outer liner of the canopy of a concave refrigerated display case.
Figure 8:
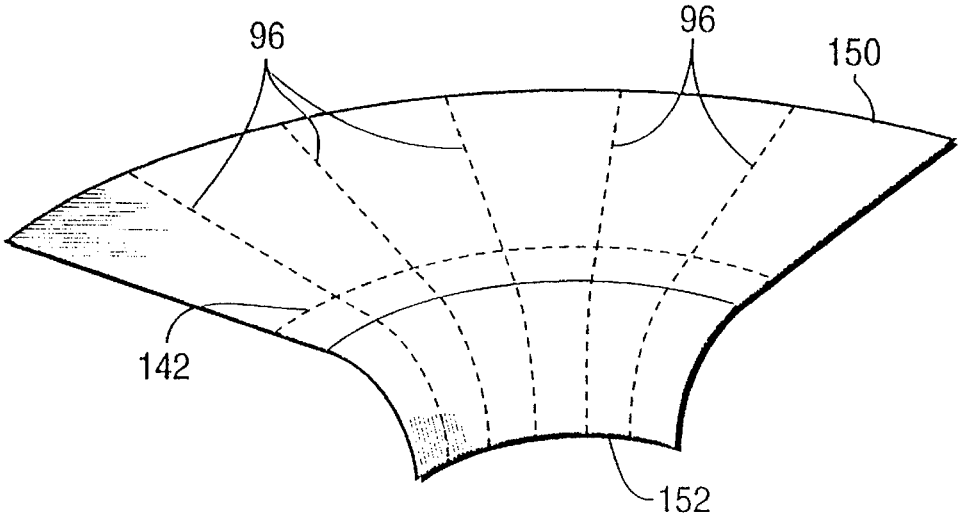
FIG. 8 is a perspective illustration of an embodiment of the configuration as shown in FIG. 5 shown cut for use in forming the inner liner of the canopy of a concave refrigerated display case.

In particular, FIG. 4 shows the outer modular member 38 after being cut for use as a concave canopy outer liner wherein cuts are made along the major second outer lining 122 and the minor second outer lining 124. In a similar manner for the inner liner FIG. 8, illustrates inner modular member 58 cut along the major fourth inner lining 150 and the minor fourth inner lining 152 to provide the inner liner for a convex canopy of a refrigerated display case.

Figure 3:
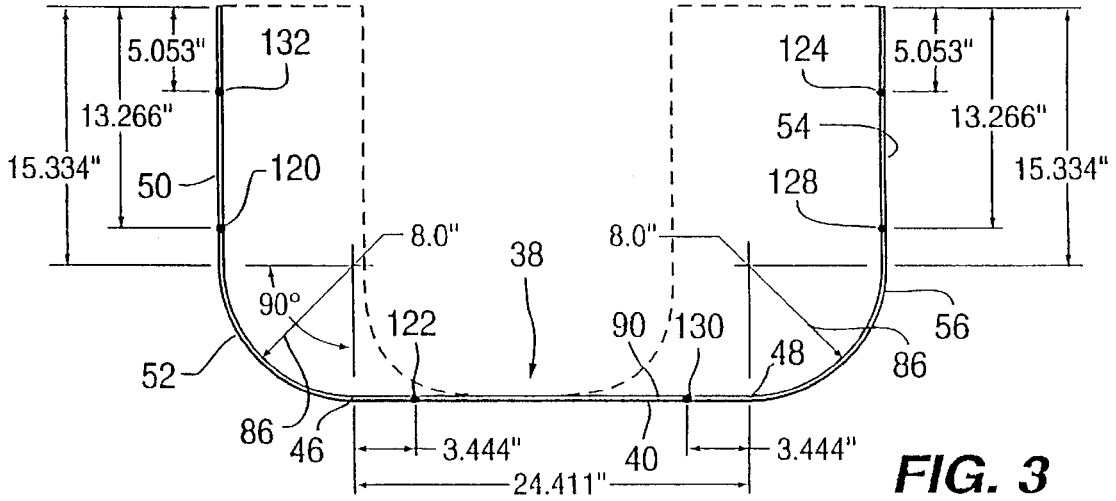
FIG. 3 is a side cross-sectional view of the embodiment shown in FIG. 1.
Figure 7:
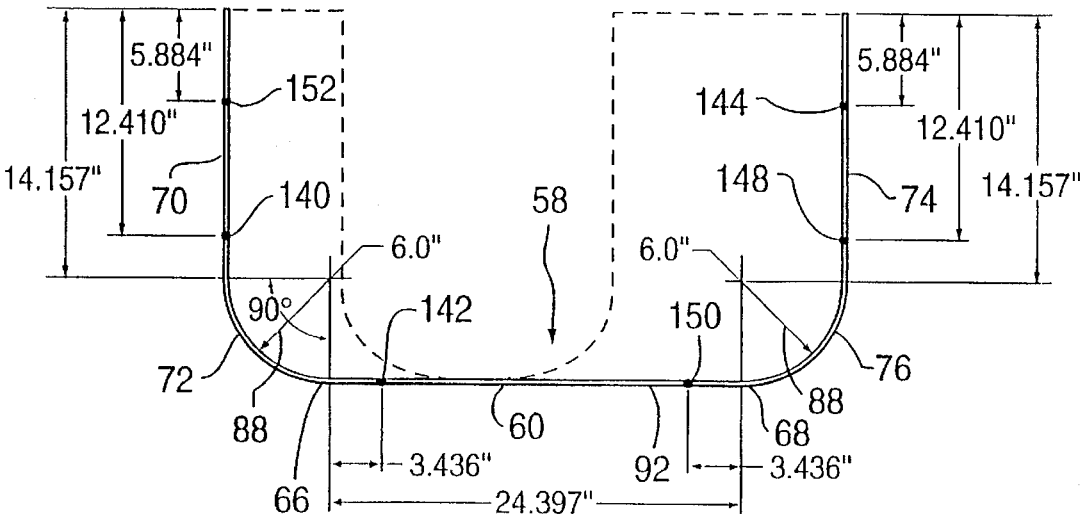
FIG. 7 is side cross-sectional view of the embodiment shown in FIG. 5.

FIG. 3 shows the proposed dimensions for forming of the outer modular member along with the approximate positioning of the various lining means thereon and the dimensions for placement thereof. Similarly FIG. 7 shows suggested positions for the lining in regard to the inner modular member 58. In FIG. 3 the eight inch radius of curvatures are shown at 86 in the corner areas thereof and in FIG. 7 the six inch radius of curvature 88 is shown in the corner members 72 and 76 thereof. It should be appreciated that the choice of six and eight inches for the respective radii of curvature in the corners of the inner and outer modular members 38 and 58 is only a preferred configuration for use in the present embodiment. It is preferable that the inner panel include a radius of curvature in the corners which is less than that of the outer panel but the present invention does not contemplate a restriction thereof to the six and eight inch range, respectively.

One of the unique advantages of the curved sections 34 and 36 of refrigerated display cases 10 formed by the apparatus of the present invention is in the configuration of the ends. The ends of the curved case sections, either the concave sections 36 or the convex sections 34, have the same profile or configuration as the ends of the straight cases thereby greatly facilitating securement and interconnection therebetween. In this manner a smooth flowing and handsome line of cases can be positioned within a retail supermarket which includes both curved and straight sections without any noticeable transitions or gaps or interconnecting members therebetween.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A method for constructing a thermally insulated housing for a curved section of a refrigerated display case from a plurality of similarly shaped outer liner members and a plurality of similarly shaped inner liner members usable for forming both concave and convex curved case sections, the method comprising:

A. forming a plurality of outer modular members each including a generally planar arc shaped outer horizontal panel having a first outer longitudinal end and a second outer longitudinal end positioned spaced apart from and oriented perpendicularly with respect to each other, each outer modular member being formed with an outer narrow arcuate end and an outer wide arcuate end extending between the first outer longitudinal end and the second outer longitudinal end, each outer modular member further provided with an outer narrow vertical panel extending upwardly from the outer narrow arcuate end generally perpendicularly with respect to the outer horizontal panel and an outer narrow corner member extending between the outer narrow arcuate end and the outer narrow vertical panel and extending through an angle of approximately ninety degrees, each outer modular member further provided with an outer wide vertical panel extending upwardly from the outer wide arcuate end generally perpendicularly with respect to the outer horizontal panel and an outer wide corner member extending between the outer wide arcuate end and the outer wide vertical panel and extending through an angle of approximately ninety degrees; and B. forming a plurality of inner modular members each including a generally planar arc-shaped inner horizontal panel having a first inner longitudinal end and a second inner longitudinal end positioned spaced apart from and oriented perpendicularly with respect to each other, each inner modular member being formed with an inner narrow arcuate end and an inner wide arcuate end extending between the first inner longitudinal end and the second inner longitudinal end, each inner modular member further provided with an inner narrow vertical panel extending upwardly from the inner narrow arcuate end generally perpendicularly with respect to the inner horizontal panel and an inner narrow corner member extending between the inner narrow arcuate end and the inner narrow vertical panel and extending through an angle of approximately ninety degrees with a radius of curvature less than that of the outer narrow corner member, each inner modular member further provided with an inner wide vertical panel extending upwardly from the inner wide arcuate end generally perpendicularly with respect to the inner horizontal panel and an inner wide corner member extending between the inner wide arcuate end and the inner wide vertical panel and extending through an angle of approximately ninety degrees with a radius of curvature less than that of the outer wide corner member;

C. first outer marking of each outer modular member with a first outer lining extending approximately horizontally at an intermediate location on the outer narrow vertical panel for indicating the position for cutting of the outer modular member therealong for facilitating use thereof as the outer liner of a concave tank section of a refrigerated display case;

D. second outer marking of each outer modular member with a second outer lining including a major second outer lining extending through an arc passing across the outer horizontal panel from the first outer longitudinal end to the second outer longitudinal end thereof and a minor second outer lining extending approximately horizontally at an intermediate location on the outer wide vertical panel for indicating the position for cutting of the outer modular member therealong for facilitating use thereof as the outer canopy liner of a concave refrigerated display case;

E. third outer marking of each outer modular member with a third outer lining extending approximately horizontally at an intermediate location on the outer wide vertical panel for indicating the position for cutting of the outer modular member therealong for facilitating use thereof as the outer tank liner of a convex refrigerated display case; and F. fourth outer marking of each outer modular member with a fourth outer lining including a major fourth outer lining extending through an arc passing across the outer horizontal panel from the first outer longitudinal end to the second outer longitudinal end thereof and a minor fourth outer lining extending approximately horizontally at an intermediate location on the outer narrow vertical panel for indicating the position for cutting of the outer modular member therealong for facilitating use thereof as the outer canopy liner of a convex refrigerated display case;

G. first inner marking of each inner modular member with a first inner lining extending approximately horizontally at an intermediate location on the inner narrow vertical panel for indicating the position for cutting of the inner modular member therealong for facilitating use thereof as the inner tank liner of a concave refrigerated display case;

H. second inner marking of each inner modular member with a second inner lining including a major second inner lining extending through an arc passing across the inner horizontal panel from the first inner longitudinal end to the second inner longitudinal end thereof and a minor second inner lining extending approximately horizontally at an intermediate location on the inner wide vertical panel for indicating the position for cutting of the inner modular member therealong for facilitating use thereof as the inner canopy liner of a concave refrigerated display case;

I. third inner marking of each inner modular member with a third inner lining extending approximately horizontally at an intermediate location on the inner wide vertical panel for indicating the position for cutting of the inner modular member therealong for facilitating use thereof as the inner tank liner of a convex refrigerated display case; and J. fourth inner marking of each inner modular member with a fourth inner lining including a major fourth inner lining extending through an arc passing across the inner horizontal panel from the first inner longitudinal end to the second inner longitudinal end thereof and a minor fourth inner lining extending approximately horizontally at an intermediate location on the inner narrow vertical panel for indicating the position for cutting of the inner modular member therealong for facilitating use thereof as the inner canopy liner of a convex refrigerated display case.

2. A method for constructing a thermally insulated housing for a curved section of a refrigerated display case as defined in claim 1 including:

A. cutting of an outer modular member along the first outer lining thereof for use as the outer tank liner of a concave refrigerated display case;

B. cutting of an inner modular member along the first inner lining thereof for use as the inner tank liner of a concave refrigerated display case;

C. affixing of the outer modular member in spaced relation with respect to and adjacent to the inner modular member to define an insulation chamber therebetween;

D. filling of the insulation chamber with an insulation material to enhance thermal insulation characteristics thereof; and E. positioning of the affixed outer modular member and inner modular member in the tank section of a concave refrigerated display case to provide a thermally insulated housing area therein.

3. A method for constructing a thermally insulated housing for a curved section of a refrigerated display case as defined in claim 1 including:

A. cutting of an outer modular member along the major second outer lining and the minor second outer lining thereof for use as the outer canopy liner of a concave refrigerated display case;

B. cutting of an inner modular member along the major second inner lining and minor second inner lining thereof for use as the inner canopy liner of a concave refrigerated display case;

C. affixing of the outer modular member in spaced relation with respect to and adjacent to the inner modular member to define an insulation chamber therebetween;

D. filling of the insulation chamber with an insulation material to enhance thermal insulation characteristics thereof; and E. positioning of the affixed outer modular member and inner modular member in the canopy section of a concave refrigerated display case to provide a thermally insulated housing area therein.

4. A method for constructing a thermally insulated housing for a curved section of a refrigerated display case as defined in claim 1 including:

A. cutting of an outer modular member along the third outer lining thereof for use as the outer tank liner of a convex refrigerated display case;

B. cutting of an inner modular member along the third inner lining thereof for use as the inner tank liner of a convex refrigerated display case;

C. affixing of the outer modular member in spaced relation with respect to and adjacent to the inner modular member to define an insulation chamber therebetween;

D. filling of the insulation chamber with an insulation material to enhance thermal insulation characteristics thereof; and E. positioning of the affixed outer modular member and inner modular member in the tank section of a convex refrigerated display case to provide a thermally insulated housing area therein.

5. A method for constructing a thermally insulated housing for a curved section of a refrigerated display case as defined in claim 1 including:

A. cutting of an outer modular member along the major fourth outer lining and the minor fourth outer lining thereof for use as the outer canopy liner of a convex refrigerated display case;

B. cutting of an inner modular member along the major fourth inner lining and minor fourth inner lining thereof for use as the inner canopy liner of a convex refrigerated display case;

C. affixing of the outer modular member in spaced relation with respect to and adjacent to the inner modular member to define an insulation chamber therebetween;

D. filling of the insulation chamber with an insulation material to enhance thermal insulation characteristics thereof; and E. positioning of the affixed outer modular member and inner modular member in the canopy section of a convex refrigerated display case to provide a thermally insulated housing area therein.

6. A method for constructing a thermally insulated housing for a curved section of a refrigerated display case as defined in claim 1 wherein said forming a plurality of outer modular members includes forming said outer narrow corner members and said outer wide corner members with a radius of curvature of approximately eight inches.

7. A method for constructing a thermally insulated housing for a curved section of a refrigerated display case as defined in claim 1 wherein said forming a plurality of inner modular members includes forming said inner narrow corner members and said inner wide corner members with a radius of curvature of approximately six inches.

8. A method for constructing a thermally insulated housing for a curved section of a refrigerated display case as defined in claim 1 further comprising marking outer radial lines on the outer modular members spaced apart by approximately fifteen degrees therebetween to facilitate cutting therealong to form curved sections of refrigerated display cases of less than ninety degrees.

9. A method for constructing a thermally insulated housing for a curved section of a refrigerated display case as defined in claim 1 further comprising marking inner radial lines on the inner modular members spaced apart by approximately fifteen degrees therebetween to facilitate cutting therealong to form curved sections of refrigerated display cases of less than ninety degrees.

10. A method for constructing a thermally insulated housing for a curved section of a refrigerated display case as defined in claim 1 further comprising texturing of a portion of the outer modular members to facilitate adherence of insulation thereto.

11. A method for constructing a thermally insulated housing for a curved section of a refrigerated display case as defined in claim 1 further comprising texturing of a portion of the inner modular members to facilitate adherence of insulation thereto.

* * * * *